US006945211B2

(12) United States Patent
Nagahashi et al.

(10) Patent No.: US 6,945,211 B2
(45) Date of Patent: Sep. 20, 2005

(54) CYLINDER HEAD OF AN INTERNAL COMBUSTION ENGINE

(75) Inventors: Yoshiki Nagahashi, Wako (JP); Hiroshi Nakagome, Wako (JP)

(73) Assignee: Honda Motor Co, Ltd., Tokyo (JP)

( * ) Notice: Subject to any disclaimer, the term of this patent is extended or adjusted under 35 U.S.C. 154(b) by 0 days.

(21) Appl. No.: 10/784,843

(22) Filed: Feb. 23, 2004

(65) Prior Publication Data

US 2004/0182353 A1 Sep. 23, 2004

(30) Foreign Application Priority Data

Mar. 5, 2003 (JP) ..... 2003-058217

(51) Int. Cl.[7] ..... F02P 13/00; F02F 1/24; F01P 11/02

(52) U.S. Cl. ..... 123/193.5; 123/65 PE

(58) Field of Search ..... 123/193.1, 193.5, 123/193.3, 65 PE

(56) References Cited

U.S. PATENT DOCUMENTS 3,791,482 A * 2/1974 Sykora ..... 181/229
3,945,354 A * 3/1976 Johnston ..... 123/65 P
4,566,409 A * 1/1986 Yashiro et al. ..... 123/65 PE
4,938,182 A * 7/1990 Shiozawa ..... 123/193.5
5,671,709 A * 9/1997 Sokoloski ..... 123/193.5
6,513,506 B1 * 2/2003 Ito et al. ..... 123/568.13

FOREIGN PATENT DOCUMENTS

JP 7-259641 * 10/1995
JP 2002-213334 * 7/2002

* cited by examiner

*Primary Examiner*—Marguerite McMahon
(74) *Attorney, Agent, or Firm*—Hamre, Schumann, Mueller & Larson, P.C.

(57) ABSTRACT

In a cylinder head of an internal combustion engine, a plug hole for mounting an ignition plug is formed along a cylinder axis and an intake port and an exhaust port are respectively formed at both sides of the plug hole while sandwiching the cylinder axis therebetween. The cylinder head further includes an intake valve which opens or closes the intake port and an exhaust valve which opens or closes the exhaust port. In such a constitution, a cross-sectional shape of a flow passage of an outlet of the exhaust port is an oval shape extending in the horizontal direction and a water drain hole of the plug hole is formed below the exhaust port.

10 Claims, 10 Drawing Sheets

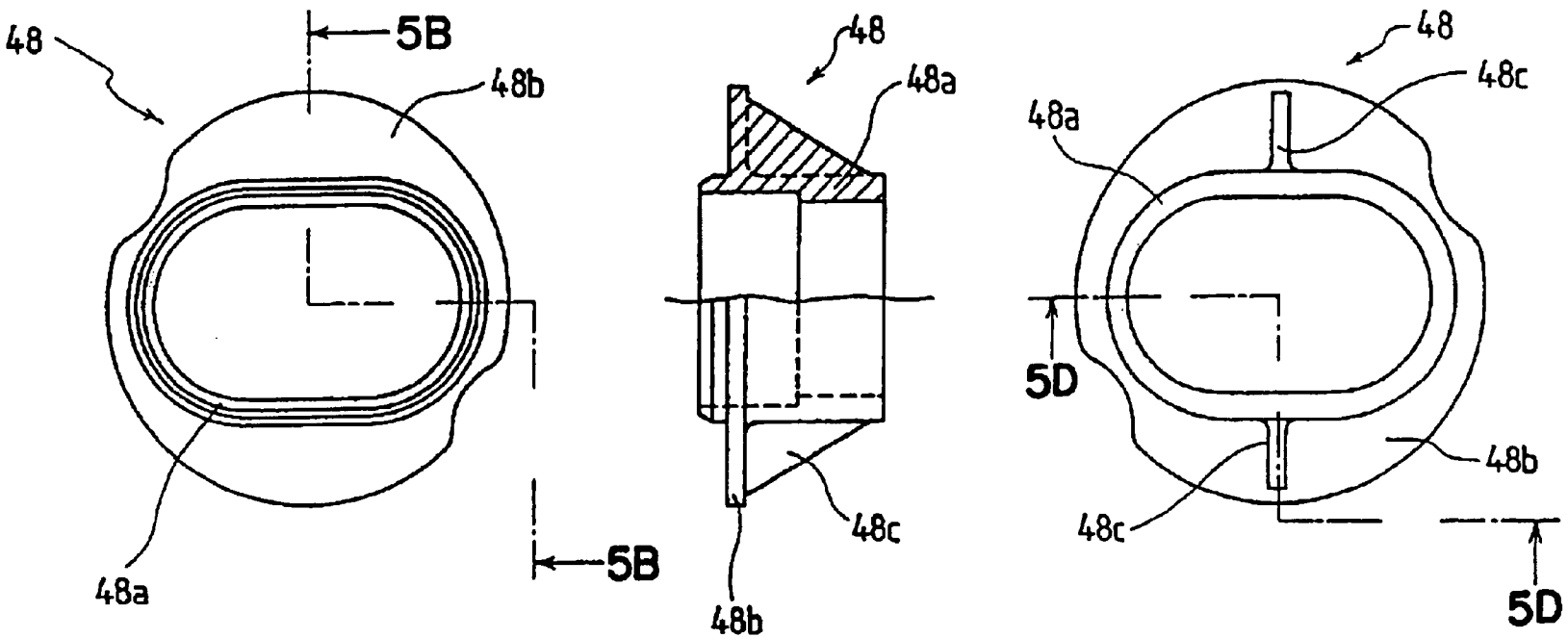
FIG. 5A
FIG. 5B
FIG. 5C
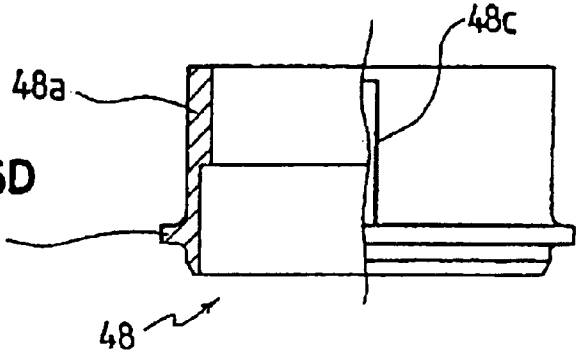
FIG. 5D

FIG. 6A
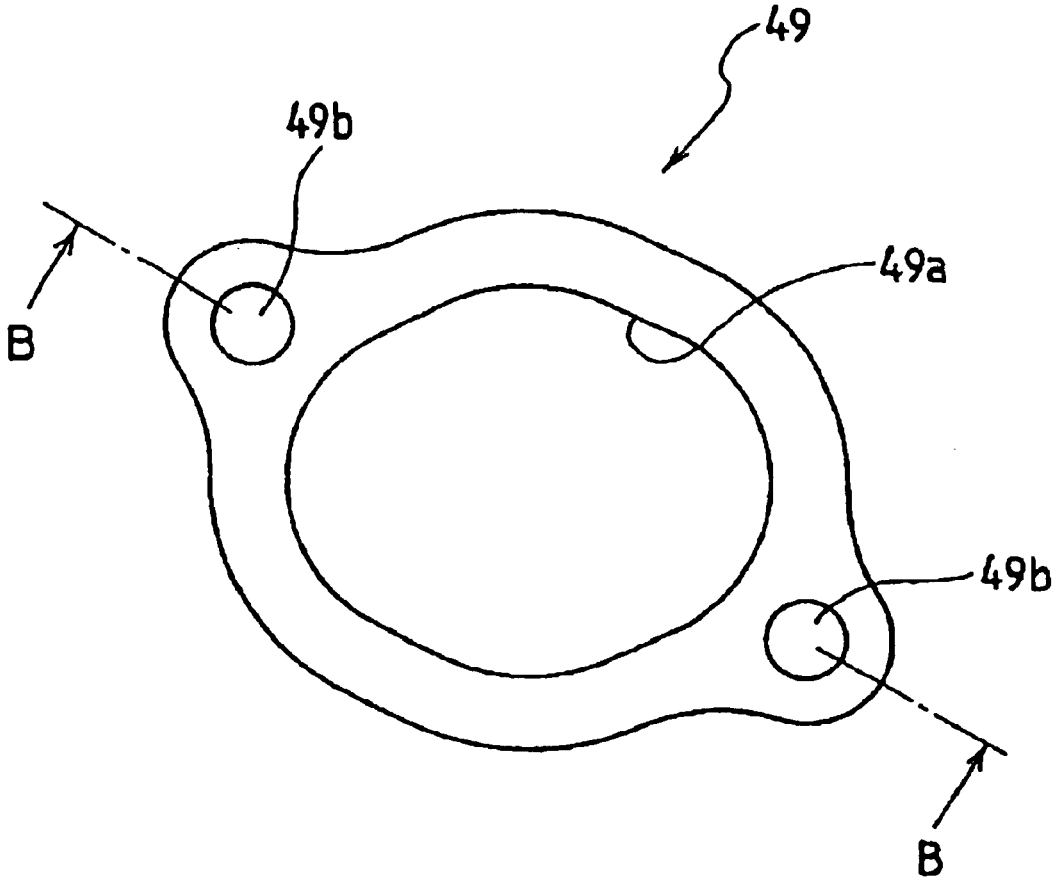
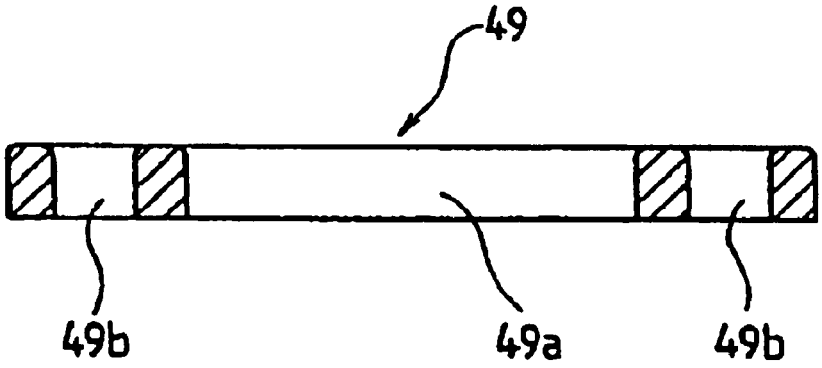
FIG. 6B

CYLINDER HEAD OF AN INTERNAL COMBUSTION ENGINE

FIELD OF THE INVENTION

The present invention relates to a cross-sectional shape of a flow passage of an outlet of an exhaust port of an internal combustion engine and an outlet position of a water drain hole of a plug hole for mounting an ignition plug.

BACKGROUND OF THE INVENTION

Conventionally, there has been disclosed a cylinder head of an internal combustion engine in which a plug hole for mounting an ignition plug is formed along a cylinder axis, an intake port and an exhaust port are respectively formed at both sides of the plug hole while sandwiching the cylinder axis therebetween, and an outlet of a water drain hole of the plug hole opens below an outlet of the exhaust port. See, for example, JP-A-7-259641 and JP-A-2002-213334.

FIG. 9 is a longitudinal cross-sectional view showing one example of a cylinder head of a conventional internal combustion engine and FIG. 10 is a view showing a shape of an outlet of an exhaust port of the cylinder head shown in FIG. 9.

First of all, in FIG. 9, a plug hole 041 for mounting an ignition plug not shown in the drawing is provided on or along a cylinder axis 025 of a cylinder head 022. Further, an intake port 034 and an exhaust port 035 are respectively provided at both sides of the plug hole 041 while sandwiching the plug hole 041 therebetween. Numeral 033 indicates a combustion chamber, numeral 036 indicates an axis of an intake valve and numeral 037 indicates an axis of an exhaust valve. Further, numeral 042 indicates a water drain hole of the plug hole 041. A cooling water passage 043 is formed in the cylinder head 022 while keeping away from these elements. A cross-sectional shape of a flow passage of an outlet of the exhaust port 035 is formed substantially in a circular shape as shown in FIG. 10. Below the outlet of the exhaust port 035, an outlet of the water drain hole 042 of the plug hole 041 opens.

In the above-mentioned cylinder head 022 of the conventional internal combustion engine, the cross-sectional shape of the flow passage of the outlet of the exhaust port 035 is substantially a circular shape and the outlet of the water drain hole 042 of the plug hole 041 opens below the outlet of the exhaust port 035 and hence, there is no other way but to form the water drain hole 042 at a lower position in the cylinder head 022. Accordingly, a cooling water passage 043*a* disposed below the water drain hole 042 cannot be enlarged and hence, it is difficult to ensure a sufficient flow of cooling water thus exhibiting the poor cooling efficiency of the cylinder head 022.

SUMMARY OF THE INVENTION

To solve the above-mentioned problems of the prior art, a cylinder head of an internal combustion engine in which a plug hole for mounting an ignition plug is formed along a cylinder axis, and an intake port and an exhaust port are respectively formed at both sides of the plug hole while sandwiching the cylinder axis therebetween, the cylinder head further including an intake valve which opens or closes the intake port and an exhaust valve which opens or closes the exhaust port, wherein a cross-sectional shape of a flow passage of an outlet of the exhaust port is an oval shape extending in the horizontal direction and a water drain hole of the plug hole is formed below the exhaust port.

Since the invention is constituted as mentioned above, it is possible to make the outlet of the water drain hole of the plug hole for mounting the ignition plug opened at a high position of the cylinder head. Accordingly, it is possible to provide the water drain hole at a higher position compared to the conventional cylinder head and hence, a cooling water passage disposed below the water drain hole can be sufficiently enlarged whereby it is possible to make a large quantity of cooling water flow thus enhancing the cooling efficiency of the cylinder head.

In another embodiment, a cylinder head of an internal combustion engine in which a plug hole for mounting an ignition plug is formed along a cylinder axis, and an intake port and an exhaust port are respectively formed at both sides of the plug hole while sandwiching the cylinder axis therebetween, the cylinder head further including an intake valve which opens or closes the intake port and an exhaust valve which opens or closes the exhaust port, wherein a cross-sectional shape of a flow passage of an outlet of the exhaust port is a shape obtained by flattening a lower portion of a circular shape and a water drain hole of the plug hole is formed below the exhaust port.

Accordingly, it is possible to make the outlet of the water drain hole of the plug hole for mounting the ignition plug opened at a high position of the cylinder head. Accordingly, it is possible to provide the water drain hole at a higher position compared to the conventional cylinder head and hence, a cooling water passage disposed below the water drain hole can be sufficiently enlarged whereby it is possible to make a large quantity of cooling water flow thus enhancing the cooling efficiency of the cylinder head.

An outlet of the water drain hole of the plug hole opens in the vicinity of a position below the outlet of the exhaust port. In this manner, the water drain hole of the plug hole is opened in the vicinity of the position below the outlet of the exhaust port and hence, it is possible to provide the water drain hole at a higher position compared to the conventional cylinder head and hence, a cooling water passage disposed below the water drain hole can be sufficiently enlarged whereby it is possible to make a large quantity of cooling water flow thus enhancing the cooling efficiency of the cylinder head.

Further, an outlet of the water drain hole of the plug hole opens inside a circle which circumscribes an outer periphery of a gasket provided to the outlet of the exhaust port. Accordingly, it is possible to provide the water drain hole at a higher position compared to the conventional cylinder head and hence, a cooling water passage disposed below the water drain hole can be sufficiently enlarged whereby it is possible to make a large quantity of cooling water flow thus enhancing the cooling efficiency of the cylinder head.

BRIEF DESCRIPTION OF THE DRAWINGS

FIG. 5 is a view showing a mouth collar used in a connecting portion between the above-mentioned outlet of the exhaust port and a discharge pipe, wherein FIG. 5(*a*) is a front view, FIG. 5(*b*) is a view as viewed from a line B—B in FIG. 5(*a*) in an arrow direction, FIG. 5(*c*) is a back view, and FIG. 5(*d*) is a view as viewed from a line D—D in FIG. 5(*c*) in an arrow direction.

FIG. 6 is a view showing an exhaust pipe joint used in a connecting portion between the outlet of the above-mentioned exhaust port and the above-mentioned exhaust pipe, wherein FIG. 6(*a*) is a front view and FIG. 6(*b*) is a cross-sectional view of FIG. 6(*a*) as viewed from a line B-B in an arrow direction.

DETAILED DESCRIPTION OF THE INVENTION

Figure 1:
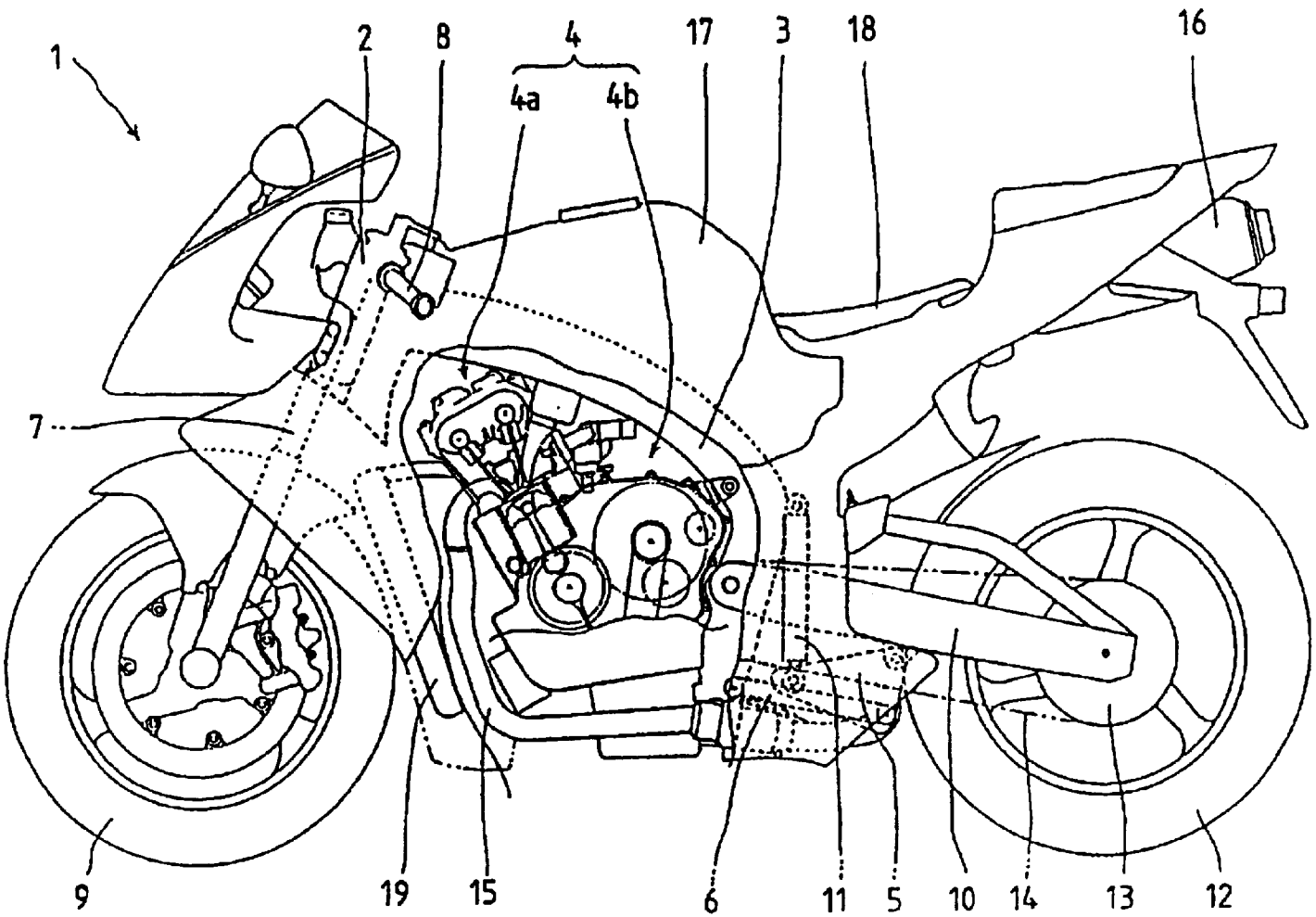
FIG. 1 is a side view with a part in cross section of a motorcycle on which an internal combustion engine to which one embodiment of the present invention is applied is mounted.

FIG. 1 is a side view with a part in cross section of a motorcycle 1 on which a water-cooled series 4-cylinder internal combustion engine to which one embodiment of the present invention is applied is mounted. From a vehicle body frame 3 which is contiguously formed with a head pipe 2 of the motorcycle 1, an internal combustion engine 4 which integrally forms a combustion apparatus portion 4*a* and a transmission portion 4*b* is suspended. The vehicle body frame 3 is constituted of a plurality of members. A front fork 7 is rotatably supported on the head pipe 2, a steering handle 8 is mounted on an upper end of the front fork 7, and a front wheel 9 is pivotally mounted on a lower end of the front fork 7.

A rear fork 10 has a front end thereof pivotally supported on a rear portion of the vehicle body frame 3 such that the rear fork 10 is tiltable in the vertical direction. A triangular link member 5 has one corner portion thereof pivotally mounted on a center lower portion of the rear fork 10. A rod-like link member 6 is pivotally mounted on another corner portion of the triangular link member 5 and another end of the rod-like link member 6 is pivotally mounted on a lower portion of the vehicle body frame 3. Between the vehicle body frame 3 and a third corner portion of the above-mentioned triangular link member 5, a rear cushion 11 is interposed. A rear wheel 12 is pivotally mounted on a lower end of the rear fork 10. The rear wheel 12 is driven by a chain 14 which is wound around a drive sprocket wheel which is mounted on a shaft end of a counter shaft of the transmission portion 4*b* of the internal combustion engine 4 and a driven sprocket 13 mounted on a shaft of the rear wheel.

The counter shaft of the transmission portion is arranged parallel to a crank shaft or the like and extends in the lateral direction of a vehicle body. An exhaust pipe 15 which is communicably connected with an exhaust port formed in a front side of the internal combustion engine 4 turns about a side of a lower portion of the internal combustion engine and reaches a rear portion of the vehicle body, and is connected to an exhaust muffler 16. A fuel tank 17 is mounted on an upper portion of the vehicle body frame 3, and a sheet 18 is provided behind the fuel tank 17. This internal combustion engine is a water-cooled type, wherein water whose temperature is elevated in a step for cooling the cylinder and oil is cooled by a radiator 19.

Figure 2:
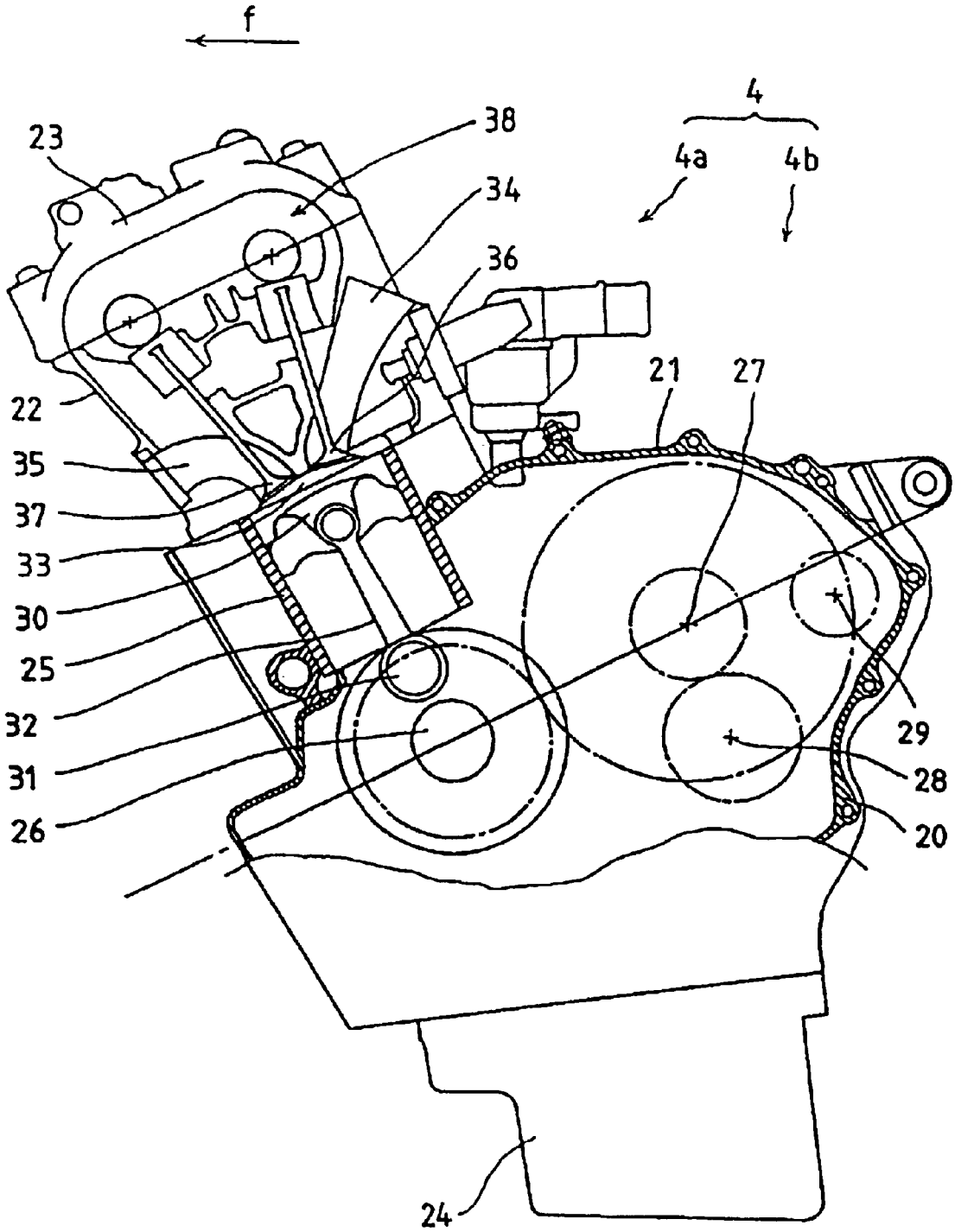
FIG. 2 is a longitudinal cross-sectional view of the above-mentioned internal combustion engine.

FIG. 2 is a longitudinal cross-sectional view of the above-mentioned water cooled 4-cylinder internal combustion engine 4. In this internal combustion engine 4, the combustion apparatus portion 4*a* and the transmission portion 4*b* are integrally formed. An arrow f indicates the front direction. An outer shell of the internal combustion engine 4 is constituted of a lower crankcase 20, an upper crankcase 21, a cylinder head 22, a cylinder head cover 23 and a lowermost oil pan 24. A cylinder 25 is integrally formed with the upper crank case 21. On bearings interposed between the lower crank case 20 and the upper crank case 21, a crank shaft 26 and a main shaft 27 of the transmission are rotatably supported. A counter shaft 28 of the transmission is rotatably supported below the main shaft 27, while a shift drum 29 is rotatably supported behind the main shaft 27. In the inside of the cylinder 25, a piston 30 is slidably housed. The piston 30 and a crank pin 31 of the crank shaft 26 are connected by a connecting rod 32.

A combustion chamber 33 is formed in a portion of a lower portion of the cylinder head 22 which faces an upper surface of the piston 30. An outlet end of an intake port 34 and an inlet end of an exhaust port 35 open in the combustion chamber 33. Although not shown in the drawing, to an inlet end of the intake port 34, an intake manifold, a carburetor, an air cleaner and the like are connected. To an outlet end of the exhaust port 35, the exhaust pipe 15 and the exhaust muffler 16 shown in FIG. 1 are connected. An intake valve 36 and an exhaust valve 37 which respectively open or close the intake port 34 and the exhaust port 35 are provided in a state that these valves 36, 37 face the internal combustion chamber 33. A valve operating mechanism 38 is provided in an upper portion of the cylinder head 22 and in the inside of the cylinder head cover 23.

Figure 3:
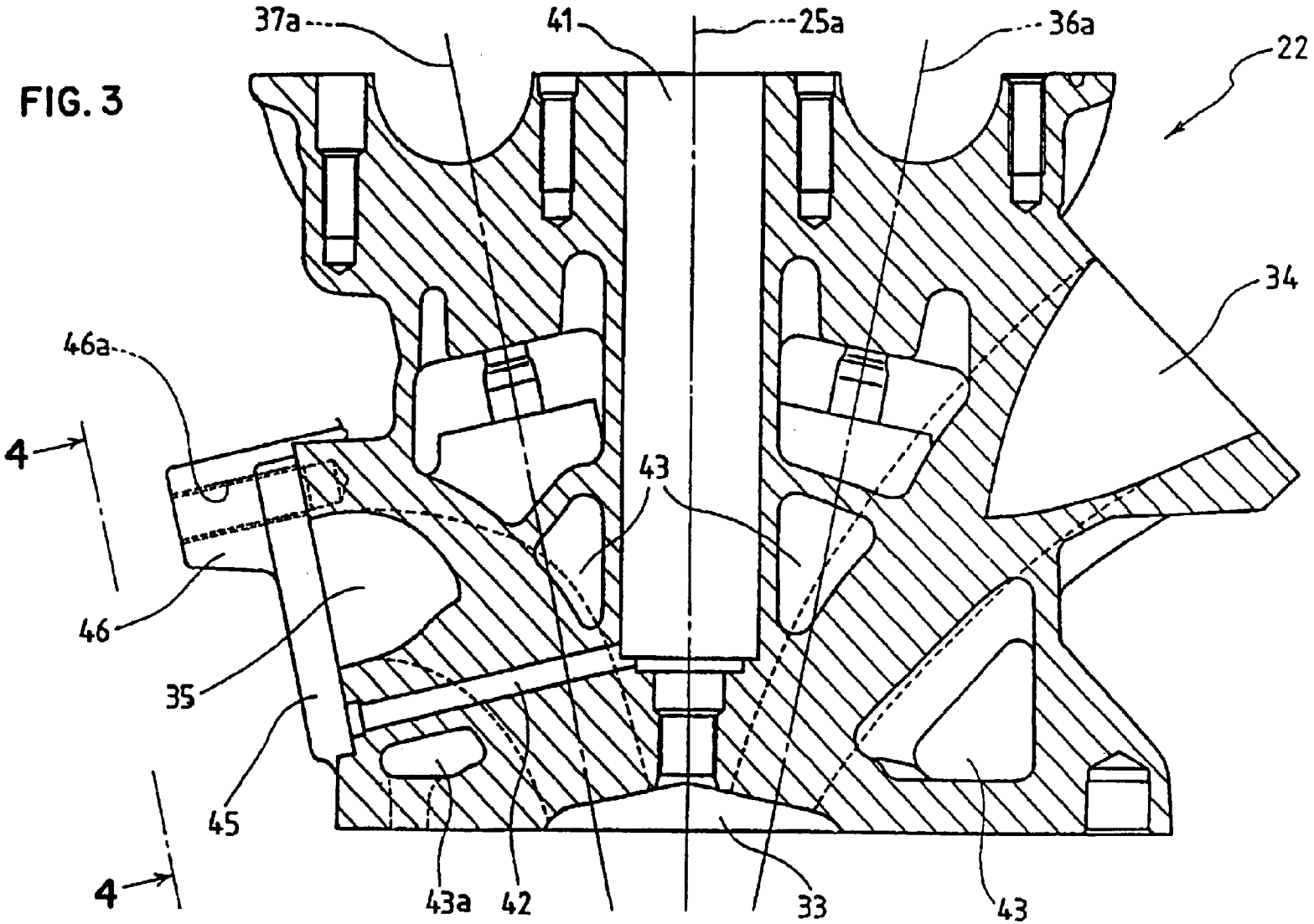
FIG. 3 is a longitudinal cross-sectional view showing a cylinder head of the above-mentioned internal combustion engine.
Figure 4:
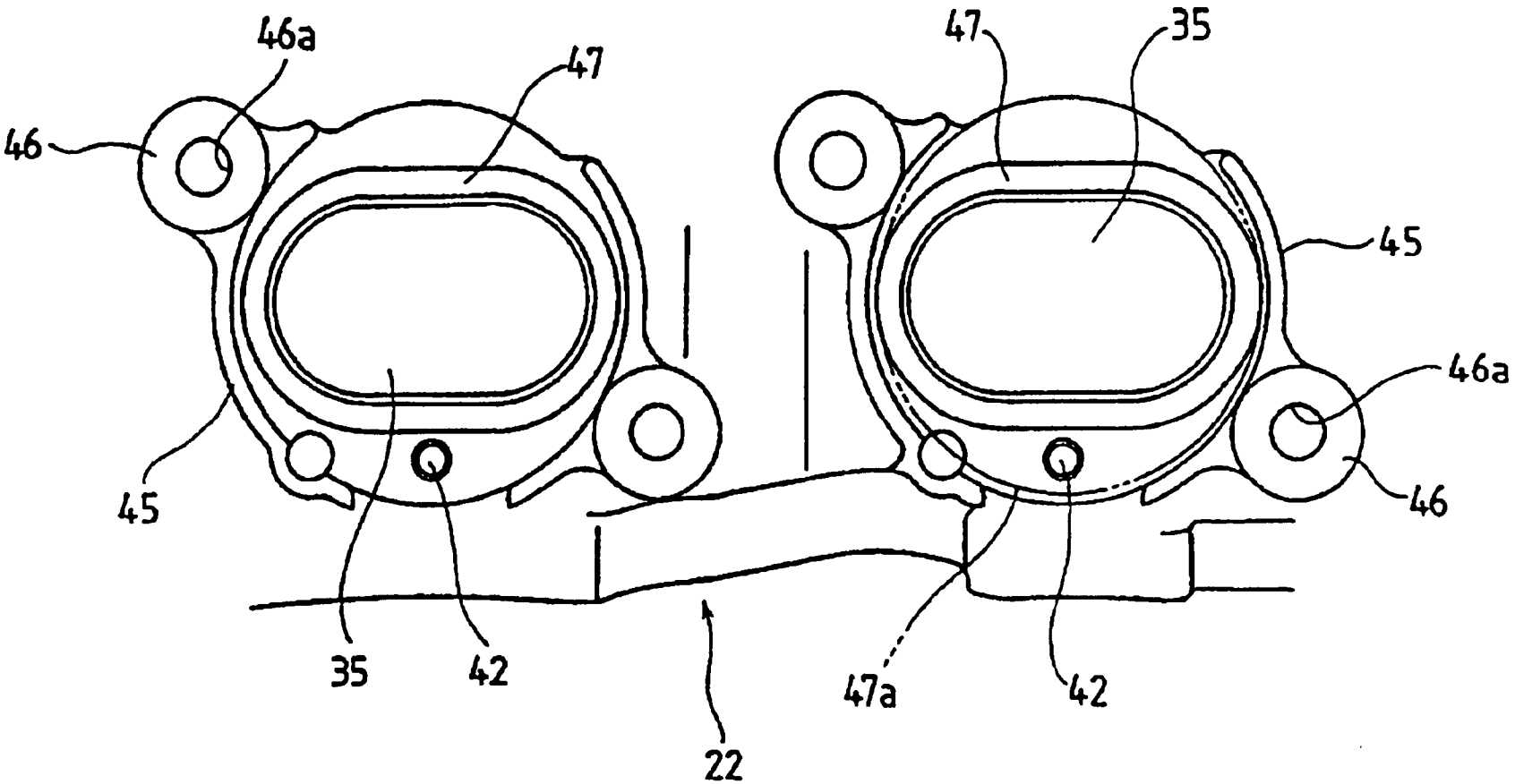
FIG. 4 is a view (a view as viewed from a line IV—IV in FIG. 3 in an arrow direction) showing a shape of an outlet of the exhaust port of the above-mentioned cylinder head.

Next, FIG. 3 is a longitudinal cross-sectional view showing the cylinder head 22 of the above-mentioned internal combustion engine 4 and FIG. 4 is a view (a view as viewed from a line IV—IV in FIG. 3 in an arrow direction) showing a shape of the outlet of the exhaust port 35 of the above-mentioned cylinder head 22.

A plug hole 41 for mounting an ignition plug not shown in the drawing is formed on or along a cylinder axis 25*a* of the cylinder head 22. Further, the intake port 34 and the exhaust port 35 are respectively formed at both sides of the plug hole 41 in a state that these ports 34, 35 sandwich the plug hole 41. Numeral 33 indicates the combustion chamber, numeral 36*a* indicates an axis of the intake valve, and numeral 37*a* indicates an axis of the exhaust valve. Further, numeral 42 indicates a water drain hole of the plug hole 41. A cooling water passage 43 is formed in the cylinder head 22 while keeping away from these elements.

In this embodiment, as shown in FIG. 4, the cross-sectional shape of a flow passage of the outlet of the exhaust port 35 has an oval shape (elliptical shape) which is elongated in the horizontal direction. A gasket 47 which also has an oval shape elongated in the horizontal direction in the same manner is mounted on the exhaust port 35 such that the gasket 47 surrounds the outlet of the exhaust port 35. Right below the gasket 47, that is, in the inside of a circumscribing circle 47*a* which circumscribes an outer periphery of the gasket 47, the outlet of the above-mentioned water drain hole 42 opens. Projection brims 45 are integrally formed with the cylinder head 22 such that the projection brims 45 surround all of these elements. Further, portions of the projection brims 45 are further projected at two portions for each outlet of the exhaust port thus forming bosses 46 and female threads 46*a* are formed in these bosses 46.

Next, FIG. 5 is a view showing a mouth collar which is used at a connecting portion between the outlet of the above-mentioned exhaust port 35 and the above-mentioned exhaust pipe 15, wherein FIG. 5(*a*) is a front view, FIG. 5(*b*) is a view as viewed from a line B—B in FIG. 5(*a*) in an arrow direction, FIG. 5(*c*) is a back view, and FIG. 5(*d*) is a view as viewed from a line D—D in FIG. 5(*c*) in an arrow direction. The mouth collar 48 is constituted of a cylindrical portion 48*a* having an oval cross-section corresponding to the shape and the size of the above-mentioned gasket 47, a flange portion 48*b* which is formed on an end portion of the cylindrical portion 48*a*, and reinforcing portions 48*c* which reinforce the cylindrical portion 48*a* and the flange portion 48*b*.

Next, FIG. 6 is a view showing an exhaust pipe joint which is used for the connection between the outlet of the exhaust port 35 and the exhaust pipe 15 cooperatively with the above-mentioned mouth collar 48, wherein FIG. 6(*a*) is a front view and FIG. 6(*b*) is a cross-sectional view taken along a line B—B in FIG. 6(*a*) in an arrow direction. The exhaust pipe joint 49 exhibits an oval ring-like shape and inner periphery 49*a* thereof has a size which allows the exhaust pipe joint 49 to surround the cylindrical portion 48*a* of the above-mentioned mouth collar 48. Further, bolt holes 49*b* are formed in the exhaust pipe joint 49 at two portions thereof corresponding to the female threads 46*a* of the above-mentioned bosses 46.

Figure 7:
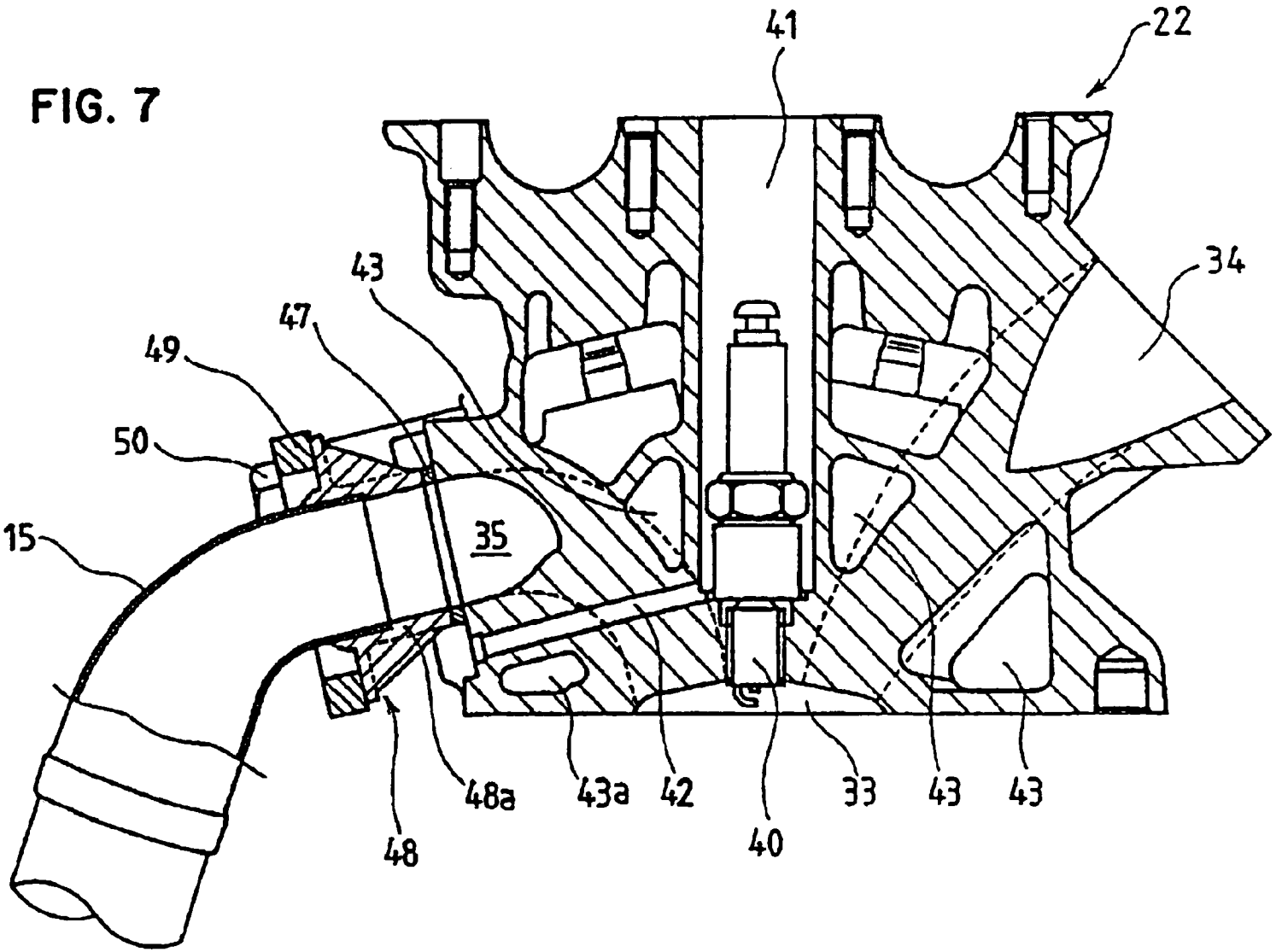
FIG. 7 is a longitudinal cross-sectional view showing a state in which the exhaust pipe is connected to the above-mentioned cylinder head.

FIG. 7 is a longitudinal cross-sectional view showing a state in which the exhaust pipe 15 is connected to the above-mentioned cylinder head 22. In this drawing, the ignition plug 40 is also depicted in the inside of the plug hole 41. A cross-section of an inlet portion of the exhaust pipe 15 also exhibits an oval shape in the same manner as the outlet portion of the exhaust port 35 and the cylindrical portion 48*a* of the mouth collar 48 is preliminary fitted into the inlet portion and is fixed to the inlet portion by welding. The gasket 47, the mouth collar 48 and the exhaust pipe joint 49 are stacked to the outlet portion of the exhaust port 35 in this order and bolts 50 are inserted into bolt holes 49*b* formed in the exhaust pipe joint 49 and are screwed into the female threads 46*a* (see FIG. 3 and FIG. 4) of the bosses 46 whereby the exhaust pipe 15 is fixed to the outlet portion of the exhaust port 35 of the cylinder head 22.

In this embodiment, the cross-sectional shape of the flow passage of the outlet of the exhaust port 35 has the oval shape which is elongated in the horizontal direction and the gasket 47 also has the oval shape which is elongated in the horizontal direction in the same manner and hence, it is possible to make the outlet of the water drain hole 42 of the plug hole 41 open at a position right below the exhaust port 35 and the gasket 47, that is, in the inside of the circumscribing circle 47*a* which circumscribes the outer periphery of the gasket 47. Accordingly, compared to the conventional cylinder head, it is possible to provide the water drain hole 42 at the higher position. As the result, the cooling water passage 43*a* disposed below the water drain hole 42 can be sufficiently enlarged and hence, it is possible to make a large quantity of cooling water flow whereby the cooling efficiency of the cylinder head 22 can be enhanced.

Figure 8:
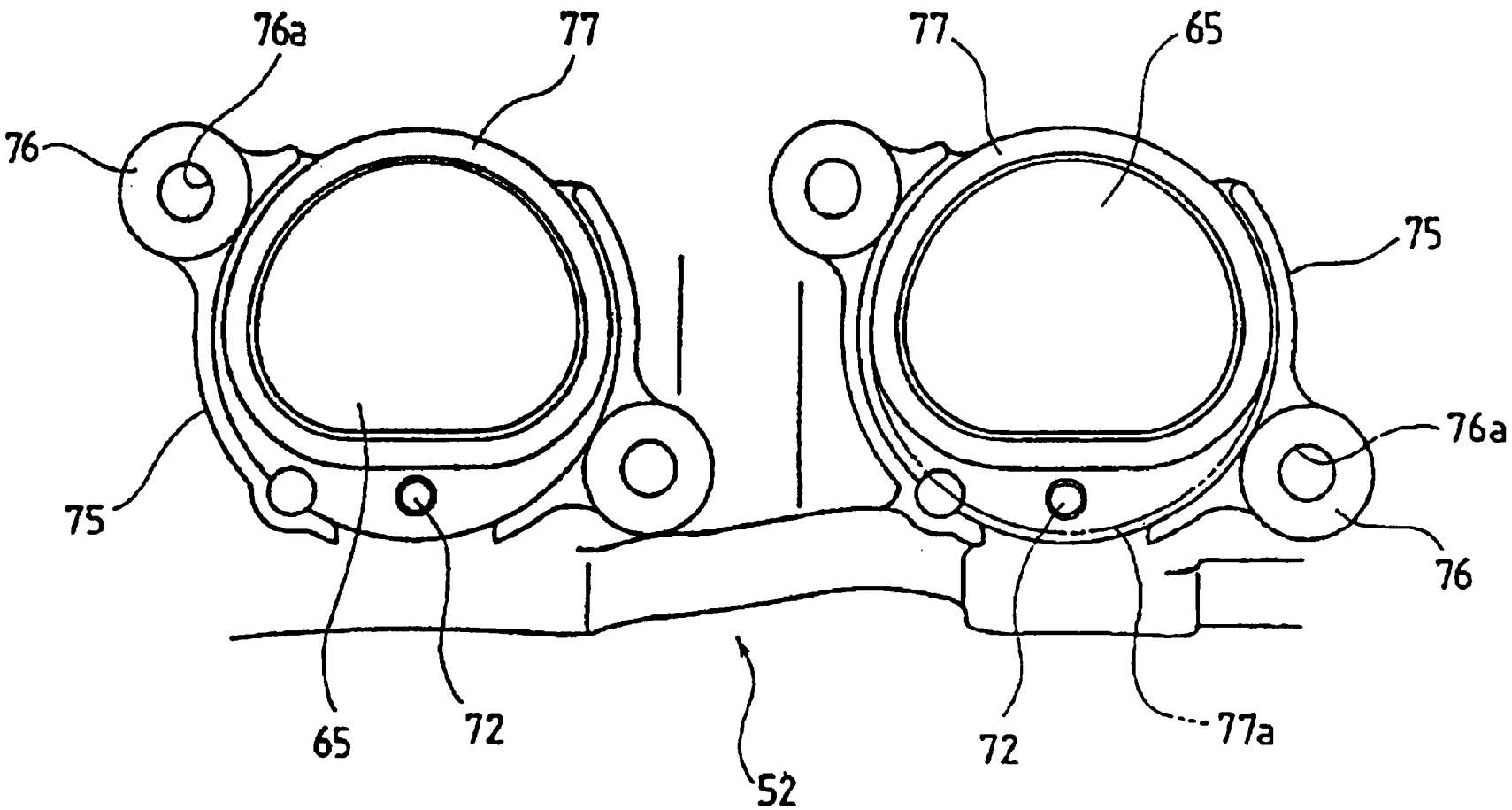
FIG. 8 is a view showing a shape of an outlet of an exhaust port of a cylinder head in the second embodiment of the present invention.
Figure 9:
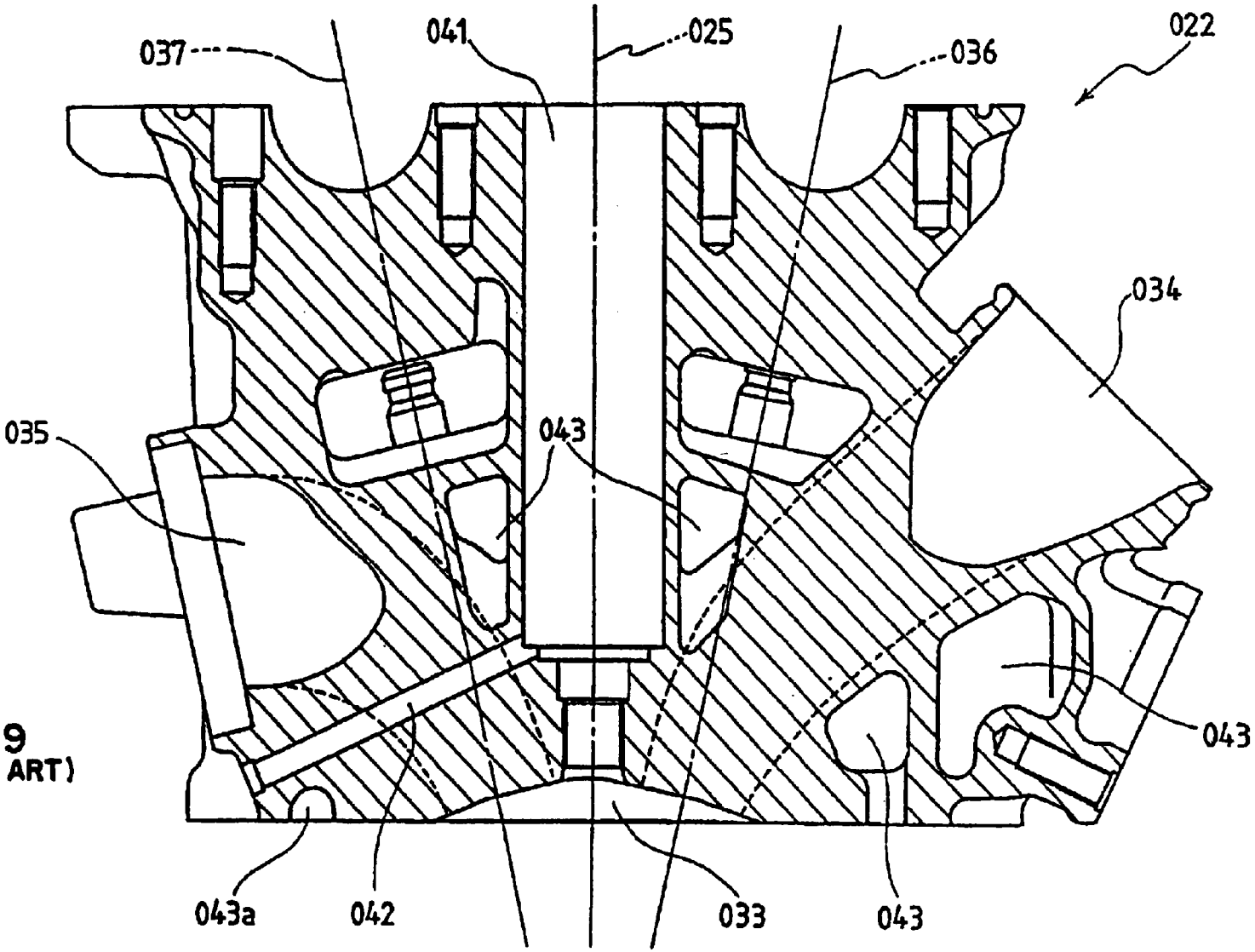
FIG. 9 (PRIOR ART)
FIG. 9 is a longitudinal cross-sectional view showing one example of a cylinder head of a conventional internal combustion engine.
Figure 10:
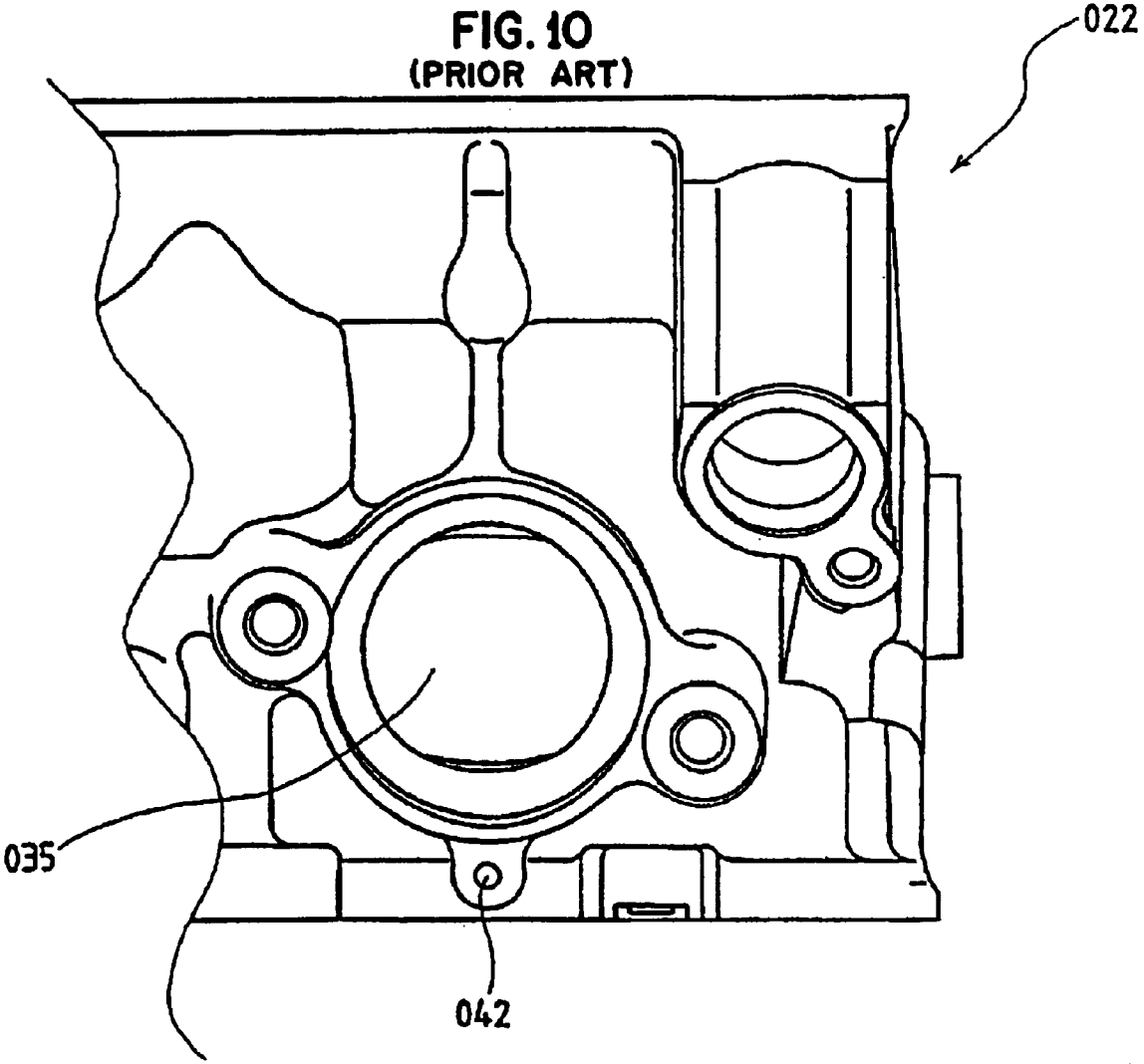
FIG. 10 (PRIOR ART)
FIG. 10 is a view showing a shape of an outlet of an exhaust port of the cylinder head shown in FIG. 9.

Next, FIG. 8 is a view showing a shape of an outlet of an exhaust port of a cylinder head 52 according to another embodiment of the present invention. In this embodiment, a cross-sectional shape of a flow passage of the outlet of an exhaust port 65 has a shape obtained by flattening a lower portion of the circular shape. A gasket 77 having a shape which is obtained by also flattening a lower portion of a circular shape is mounted such that the gasket 77 surrounds the outlet of the exhaust port 65. The outlet of the water drain hole 72 of the plug hole opens right below the gasket 77, that is, in the inside of a circumscribing circle 77*a* which circumscribes an outer periphery of the gasket 77. In the same manner as the above-mentioned first embodiment, projecting brims 75 are integrally formed with the cylinder head 52 such that the projecting brims 75 surround all of these elements and bosses 76 for forming female threads 76*a* therein are also formed.

Also to the above-mentioned cylinder head 52, an exhaust pipe is connected by way of the gasket 77 and a mouth collar, an exhaust pipe joint and bolts not shown in the drawings in the same manner as the above-mentioned first embodiment.

Also in this embodiment, it is possible to provide the water drain hole 72 at a higher position compared to the conventional cylinder head and hence, a cooling water passage disposed below the water drain hole 72 can be sufficiently enlarged whereby the cooling efficiency of the cylinder head 52 can be enhanced.

While the invention has been described in particular embodiments, it is to be understood that the words which have been used are words of description rather than limitation and that changes within the purview of the appended claims may be made without departing from the true scope and spirit of the invention in its broader aspects.

We claim:

1. A cylinder head of an internal combustion engine in which a plug hole for mounting an ignition plug is formed alone a cylinder axis, and an intake port and an exhaust port are respectively formed at both sides of the plug hole while sandwiching the cylinder axis therebetween, the cylinder head further including an intake valve which opens or closes the intake port and an exhaust valve which opens or closes the exhaust port, wherein a cross-sectional shape of a flow passage of an outlet of the exhaust port is an oval shape extending in the horizontal direction and a water drain hole of the plug hole is formed below the exhaust port, and an outlet of the water drain hole of the plug hole opens inside a circle which circumscribes an outer periphery of a gasket provided to the outlet of the exhaust port.

2. A cylinder head of an internal combustion engine according to claim 1 wherein the outlet of the water drain hole of the plug hole opens in the vicinity of a position below the outlet of the exhaust port.

3. A cylinder head of an internal combustion engine according to claim 1 wherein a cooling water passage is disposed below the water drain hole.

4. A cylinder head of an internal combustion engine according to claim 3 whereby a cooling water flow in the cooling water passage provides enhanced cooling efficiency.

5. A cylinder head of an internal combustion engine in which a plug hole for mounting an ignition plug is formed alone a cylinder axis, and an intake port and an exhaust port are respectively formed at both sides of the plug hole while sandwiching the cylinder axis therebetween, the cylinder head further including an intake valve which opens or closes the intake port and an exhaust valve which opens or closes the exhaust port, wherein a cross-sectional shape of a flow passage of an outlet of the exhaust port is a shape obtained by flattening a lower portion of a circular shape and a water drain hole of the plug hole is formed below the exhaust port, and an outlet of the water drain hole of the plug hole opens inside a circle which circumscribes an outer periphery of a gasket provided to the outlet of the exhaust port.

6. A cylinder head of an internal combustion engine according to claim 5 wherein a cooling water passage is disposed below the water drain hole.

7. A cylinder head of an internal combustion engine according to claim 5 wherein the outlet of the water drain hole of the plug hole opens in the vicinity of a position below the outlet of the exhaust port.

8. A cylinder head of an internal combustion engine according to claim 6 whereby a cooling water flow in the cooling water passage provides enhanced cooling efficiency.

9. A cylinder head of an internal combustion engine in which a plug hole for mounting an ignition plug is formed along a cylinder axis, and an intake port and an exhaust port are respectively formed at both sides of the plug hole while sandwiching the cylinder axis therebetween, the cylinder head further including an intake valve which opens or closes the intake port and an exhaust valve which opens or closes the exhaust port, wherein a cross-sectional shape of a flow passage of an outlet of the exhaust port is an oval shape extending in the horizontal direction and a water drain hole of the plug hole is formed below the exhaust port, projection brims are integrally formed with the cylinder head such that the projection brims surround a circumscribing circle which circumscribes an outer periphery of a gasket and the outlet of the water drain hole opens inside the circumscribing circle mounted on the exhaust port.

10. A cylinder head of an internal combustion engine in which a plug hole for mounting an ignition plug is formed along a cylinder axis, and an intake port and an exhaust port are respectively formed at both sides of the plug hole while sandwiching the cylinder axis therebetween, the cylinder head further including an intake valve which opens or closes the intake port and an exhaust valve which opens or closes the exhaust port, wherein a cross-sectional shape of a flow passage of an outlet of the exhaust port is a shape obtained by flattening a lower portion of a circular shape and a water drain hole of the plug hole is formed below the exhaust port, projection brims are integrally formed with the cylinder head such that the projection brims surround a circumscribing circle which circumscribes an outer periphery of a gasket and the outlet of the water drain hole opens inside the circumscribing circle mounted on the exhaust port.

* * * * *